United States Patent [19]

LaNicca

[11] Patent Number: 4,971,242

[45] Date of Patent: Nov. 20, 1990

[54] MULTIPLE CONTAINER ASSEMBLY

[75] Inventor: William C. LaNicca, Mason, Ohio

[73] Assignee: Green Bay Packaging Inc., Green Bay, Wis.

[21] Appl. No.: 495,688

[22] Filed: Mar. 19, 1990

[51] Int. Cl.[5] ..... B65D 5/48

[52] U.S. Cl. ..... 229/120.21; 229/23 R; 229/120.32; 229/915; 229/DIG. 11

[58] Field of Search ..... 229/120.01, 120.21, 229/120.32, 23 R, 23 BT, 915, DIG. 11

[56] References Cited

U.S. PATENT DOCUMENTS

| | | | |
|---|---|---|---|
| 2,719,664 | 10/1955 | Hester | 229/915 |
| 3,006,523 | 10/1961 | Keith | 229/120.32 |
| 3,286,901 | 11/1966 | Anderson | 229/23 BT |
| 4,267,959 | 5/1981 | Gilbert | 229/120.32 |
| 4,317,536 | 3/1982 | Dickerson | 229/23 BT |
| 4,739,921 | 4/1988 | Taub | 229/120.32 |

*Primary Examiner*—Gary E. Elkins

*Attorney, Agent, or Firm*—Andrus, Sceales, Starke & Sawall

[57] ABSTRACT

A multiple container assembly having particular use in handling and transporting pizzas. The assembly includes an upper container formed of folded corrugated paperboard and having a bottom wall, a side wall and a top. The upper container is stacked on a second lower container which is composed of a bottom, a side wall and an open top. A panel is connected to opposed portions of the side wall of the lower container along a fold line and each panel has a pair of spaced slits extending from the free edge of the panel to the fold line which divides each panel into a central section and a pair of end sections. The central section of each panel is folded inwardly about the fold line and disposed generally horizontal to provide a seat for the upper container, while the end sections of each panel are disposed flatwise to the side wall of the upper container. A tab is connected to the end of each end section by a second fold line and each tab is received within a vertical slit in the upper container to lock the upper container to the lower container.

14 Claims, 3 Drawing Sheets

MULTIPLE CONTAINER ASSEMBLY

BACKGROUND OF THE INVENTION

Take-out pizzas are generally sold in tuck-type folded corrugated paperboard boxes not only or containers. The corrugated paperboard box protects the pizzas during handling and transporting but also maintains the pizza in a heated condition.

Frequently a party will order more than one pizza and this occurs frequently when the pizza establishment offers a two-for-one promotion. While it would be desirable to package more than one pizza in a single box, the practice has been to package each pizza in an individual or separate box in order to protect the pizza and prevent damage to the ingredients. When two separate boxes are used, the boxes are somewhat awkward to handle due to their size and the relatively slippery nature of the paperboard material.

SUMMARY OF THE INVENTION

The invention is directed to a multiple container assembly having particular use in handling and transporting pizzas. The assembly includes an upper box or container formed of corrugated paperboard and having a bottom, side walls and a top. The upper container is stacked and locked on a lower container also formed of corrugated paperboard and composed of a bottom, side walls and an open top.

A panel is connected to the upper edge of each side wall of the lower container along a fold line, and each panel is provided with a pair of spaced slits which extend from the free edge of the panel to the fold line and divide the panel into a central section and a pair of end sections. The central section of each panel is folded inwardly about the fold line and is disposed generally normal to the side wall, thus providing a pair of ledges or seats to support the upper container.

Each end section of each panel is positioned flatwise to the respective sides of the upper container, and a tab is connected to the end of each end section by a second fold line. Each tab is inserted in a vertical slit in the upper container.

With this construction, the upper container or box is firmly locked to the lower container and cannot move vertically nor shift laterally with respect to the lower container. Further, the upper container is supported in spaced relation above the bottom of the lower container, thus ensuring that the upper container will not contact the pizza in the lower container.

As the lower container does not include a top wall, the assembly uses less material and thus is less costly than the conventional method using two separate containers or boxes.

As a further advantage, the pizza in the lower container can be removed, while the second pizza can be retained in the closes upper container to thereby maintain the second pizza in a heated condition.

The invention can be employed to stack any number of containers in superimposed relation with only the top container in the stack being a conventional tuck-type container with a full cover or top.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 7:
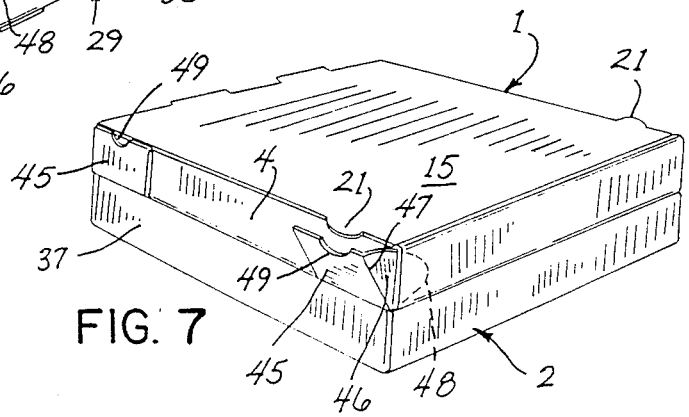
FIG. 7 is a perspective view of the completed assembly.

FIG. 7 shows a multiple box or container assembly having particular use in handling and transporting pizzas. The assembly includes an upper box or container 1 and a lower box or container 2 which supports upper container 1. Both boxes can contain a pizza or other product.

Figure 1:
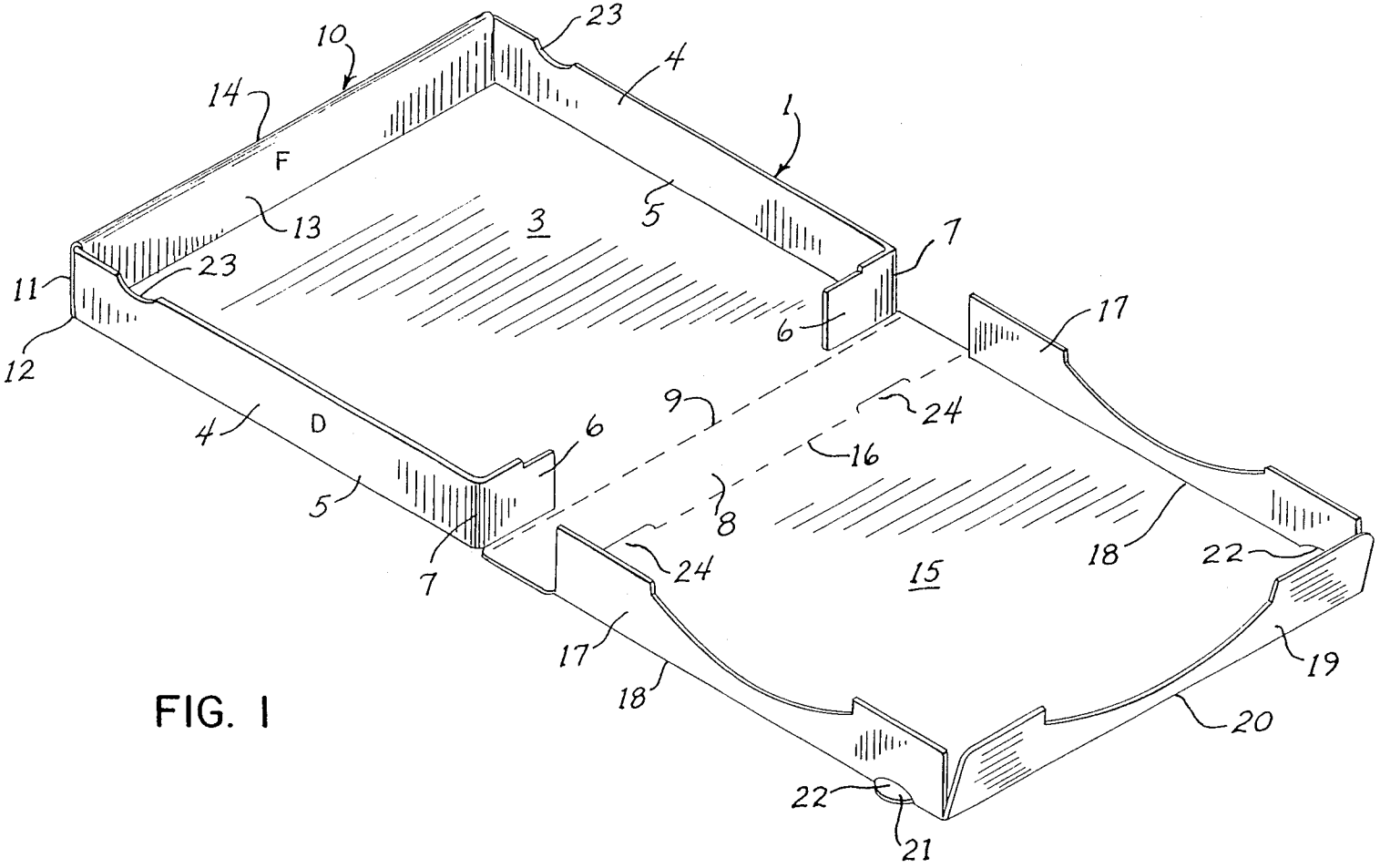
FIG. 1 is a perspective view of a partially assembled upper box or container.

Upper container 1 has a standard tuck-type construction, being generally rectangular in shape and formed of die cut corrugated paperboard. FIG. 1 shows the upper container 1 in a partially folded condition.

Upper container 1 includes a bottom 3 and a pair of side walls 4 are connected to bottom 3 along fold lines 5. Tabs 6 are connected to the ends of sides 4 along fold lines 7. As shown in FIG. 1, tabs 6 are located at right angles to side walls 4.

Figure 2:
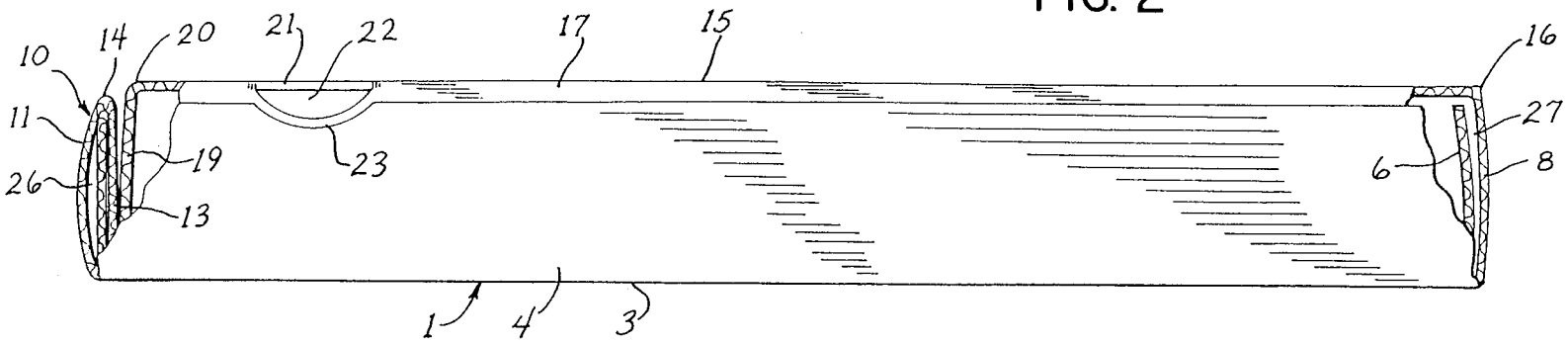
FIG. 2 is a side view of the folded upper container with parts broken away.

In addition, container 1 includes an end wall 8 which is connected to bottom 3 along fold line 9. A second end wall 10 is located opposite end wall 8 and consists of an outer wall section 11 which is connected by fold line 12 to bottom wall 3, and inner wall section 13 which is connected to outer section 11 along a pair of fold lines 14. As seen in FIG. 1, inner section 13 is folded inwardly to provide a double end wall 10. Tabs **6*a* located on the ends of side walls 4, opposite tabs 6, are inserted between wall sections 11 and 13, as seen in FIG. 2, to lock the side walls 4 to end wall 10**.

Container 1 also includes a top 15 which is connected along fold line 16 to end wall 8. In addition, a pair of side walls 17 are connected to top 15 along fold lines 18 and the side walls, as illustrated in FIG. 1, extend normal to the top 15. An end wall 19 is connected to top 15 along fold line 20 and also extends normal to top 15.

After a pizza or other product has been placed on the bottom 3, the top 15 is folded upwardly over the bottom with the side walls 17 fitting inside side walls 4 and end wall 19 being located inwardly of end wall 10.

To provide ventilation for the pizza contained within container 1, a pair of generally curved punched-out tabs 21 are formed in each side wall 17 and define vent holes 22. When each side wall 4 is formed with a notch 23, and when the top 15 is folded over bottom 3, the notches 23 register with vent holes 22.

Figure 3:
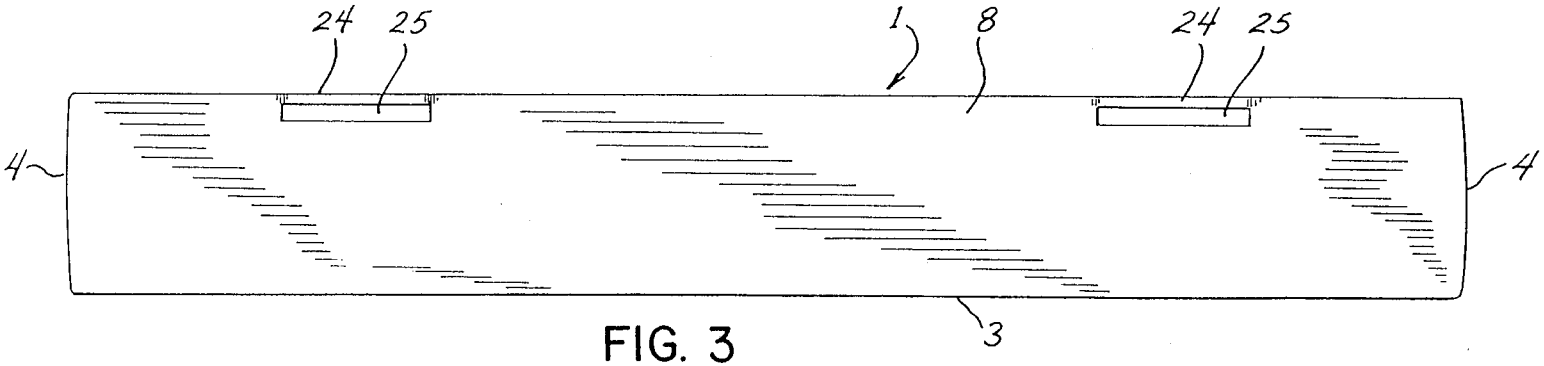
FIG. 3 is a end view of the upper container.

Additional ventilation is provided by forming fold line 16 with a pair of offsets which define tabs 24 when top 15 is folded over bottom 3. Tabs 24 form vent holes 25, as shown in FIG. 3.

When the container 1 is in the folded condition, a pair of vertical slots 26 and 27 are formed at the front and rear ends of the box, respectively, as shown in FIG. 2. Slot 26 is defined by the wall sections 11 and 13, while slot 27 is defined by end wall 8 and tabs 6.

Figure 4:
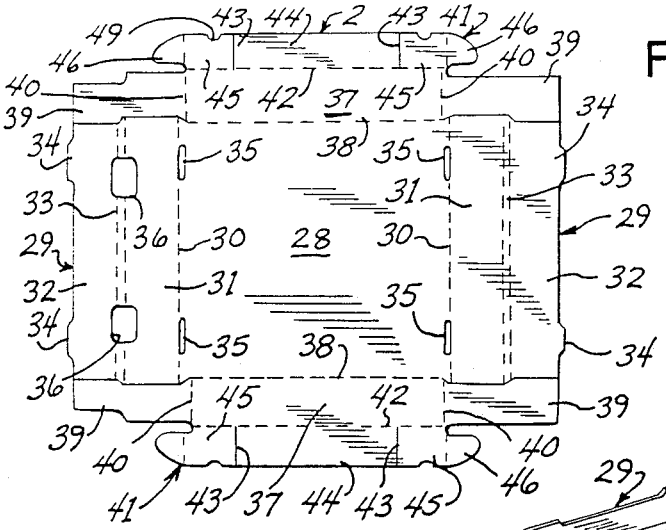
FIG. 4 is a plan view of the die cut paperboard blank for the lower container.

Lower container 2 has substantially the same size and shape as upper container 1 and is also formed of die cut corrugated paperboard. As shown in FIG. 4, lower box 2 includes a bottom 28 and a pair of double end walls 29 are connected to opposite edges of bottom wall 28 by fold lines 30. Each double end wall 29 includes a pair of sections 31 and 32 which are connected by double fold lines 33. On assembly of container 2, section 32 is folded inwardly of section 31 about the fold lines 33 and a pair of tabs 34 formed on the free edge of section 32 are inserted within slots 35 formed along fold line 30, thereby locking the end walls to the bottom 28.

To provide ventilation for the pizza contained within the lower container 2, a pair of vent holes 36 are formed in one of the end walls 29 along the double fold line 33.

Figure 5:
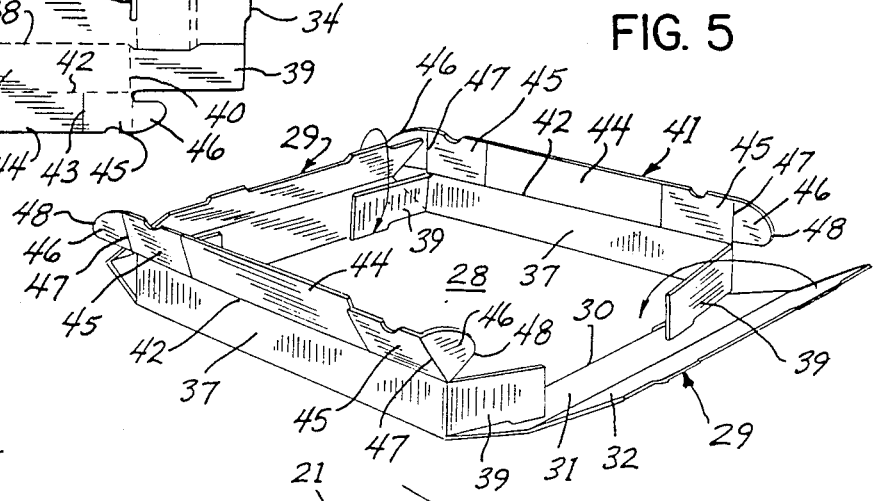
FIG. 5 is a perspective view of the lower container in a partially folded condition.

Lower container 2 also includes a pair of side walls 37 which are connected to bottom wall 28 along fold lines 38. In addition, a tab 39 is connected to each end of side wall 37 along fold line 40. As shown in FIG. 5, tabs 39 are folded inwardly and are captured between the sections 31 and 32 of end walls 29.

A panel 41 is connected to the outer edge of each side wall 37 along a fold line 42. Each panel is formed with a pair of spaced slits 43 which extend from the free outer edge of the panel to the fold line 42. Slits 43 divide the panel 41 into a central section 44 and a pair of end sections 45.

A tab or ear 46 is connected to the end of each end section 45 along a fold line 47. Each ear has a generally rounded extremity, indicated by 48.

Figure 6:
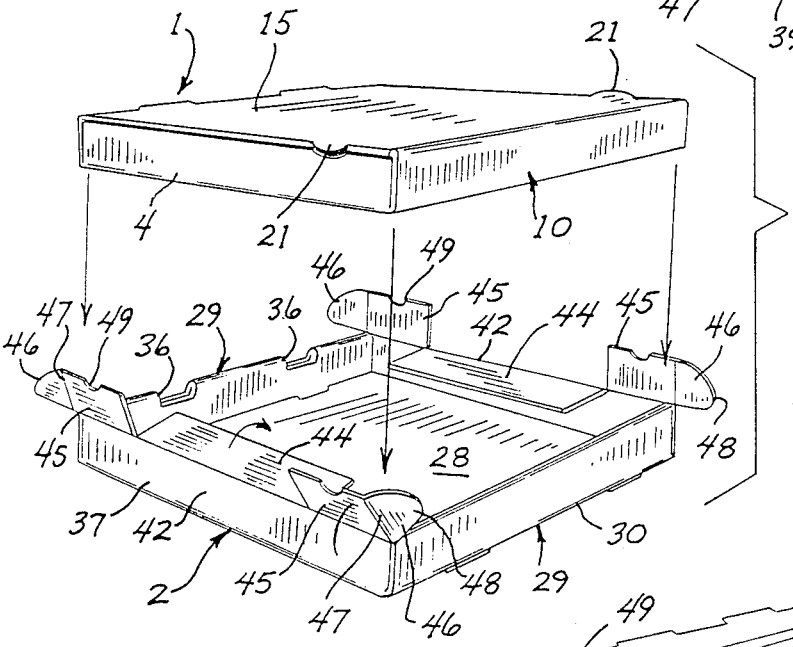
FIG. 6 is a perspective view showing the insertion of the upper container on the lower container.

After the double end walls 29 have been folded inwardly, as shown in FIG. 2, the upper container 1 is assembled to the lower container 2 as illustrated in FIG. 6. In this regard, the central sections 44 are folded inwardly along fold line 42 over the pizza in container 2 to provide shelves or ledges on which the upper container 1 can rest or seat and the end sections 43 are folded outwardly along the fold lines 42. With upper container 1 seated on sections 44, ears 46 are then inserted within the slots 26 and 27 in the upper container to firmly connect the containers together. With the ears 46 received within the slots 26, 27 the end sections 43 will be disposed flatwise against the side walls of the upper container thereby preventing lateral shifting of the upper container on the lower container.

Ears 46 can be provided with notches 49 which register with vent holes 20.

In the assembled condition the upper container 1 is firmly locked to the lower container and cannot move either vertically or laterally. In addition, the bottom surface of the upper container is spaced above the bottom of the lower container so that the upper container will not contact the pizza or other product contained in the lower container.

With this locking arrangement, a stack of two or more containers can be handled without the upper containers slipping or sliding relative to the lower containers.

Each lower container 2 has vertical slits at the corners, similar to slits 26 and 27 of the upper container. Thus, any number of containers can be stacked and locked together with only the upper container being of the standard tuck-type and including a cover or top. As the lower containers in the stack do not require a cover or top, a substantial material savings is achieved, thus resulting in a less expensive package.

Various modes of carrying out the invention are contemplated as being within the scope of the following claims particularly pointing out and distinctly claiming the subject matter which is regarded as the invention.

I claim:

1. A multiple container assembly, comprising a first container having a top, a bottom and a side wall, said side wall having an opening therein, a second container having a bottom, a side wall and an open top, a pair of ledges extending inwardly from opposite portions of the side wall of the second container and disposed to support the bottom of said first container, and tab means connected to the side wall of the lower container and having a portion constructed and arranged to be received in the opening in said first container to thereby lock the first container to said second container.

2. The assembly of claim 1, wherein said opening comprises at least one vertically extending slit.

3. The assembly of claim 2, wherein said first container is generally rectangular in shape and is provided with four slits, said tab means comprising four tabs to be received in the respective slits.

4. The assembly of claim 3, wherein the slits are disposed adjacent the corners of said first container.

5. The assembly of claim 1, wherein said second container is rectangular in shape and said side wall includes a pair of opposed parallel side wall sections, said ledges extending inwardly from said opposed side wall sections.

6. The assembly of claim 5, wherein said ledges are connected to said side wall sections along fold lines.

7. A multiple container assembly, comprising a folded upper container having a top, a side wall and a bottom, a folded lower container having a bottom, a side wall and an open top, said side wall of said lower container including a pair of opposed side wall sections, a panel connected to an upper edge of each side wall section along a first fold line, each panel having a pair of spaced slits extending from a free edge of said panel to said fold line and dividing each panel into a central section and pair of end sections, said central section being folded inwardly about said first fold line and disposed generally horizontally to provide a seat for said upper container, said end sections disposed flatwise to the side walls of said upper container, and a tab connected to an end of each end section along a second fold line, said upper container having a vertically extending slit adjacent each corner thereof, each tab being received in a slit in said upper container.

8. The assembly of claim 7, and including a vent means in said second container.

9. The assembly of claim 7, and including a vent hole in the side wall of said upper container, one of said end sections of said lower container having a notch registering with said vent hole.

10. The assembly of claim 7, wherein each tab is disposed normal to the respective end section.

11. The assembly of claim 7, wherein the side wall of said lower container includes a pair of opposed second wall sections, each second wall section including an inner wall member and an outer wall member disposed generally flatwise to said inner wall member.

12. The assembly of claim 11, wherein said inner and outer wall members are separated by a vertically extending slit disposed to receive a tab from a second lower container.

13. A multiple container assembly, comprising a generally rectangular folded upper container having a top, a bottom and a side wall interconnecting said top and bottom, said upper container having at least one vertically extending slot therein, a generally rectangular folded lower container having a bottom and a side wall and an open top, the side wall of said lower container including a pair of opposed side wall sections, a panel secured to an upper edge of each side wall section along a first fold line, each panel having a slit extending from a free edge of the panel to said first fold line and dividing said panel into a central section and an end section, each of said central stations being folded inwardly about said first fold line and disposed generally horizontally to provide a seat for said upper container, each end section extending generally vertically and disposed generally flatwise to the side wall of the upper container, and an ear connected to an end of each end section along a second fold line, each ear being disposed normal to the respective end section and engaged with a respective one of said slots in said upper container to lock the upper container to the lower container.

14. The assembly of claim 13, wherein said upper and lower containers are formed of corrugated paperboard.

* * * * *